US007736136B2

(12) United States Patent
Ohtake

(10) Patent No.: US 7,736,136 B2
(45) **Date of Patent: *Jun. 15, 2010**

(54) COMPRESSOR INCLUDING SEPARATION TUBE ENGAGEMENT MECHANISM

(75) Inventor: Shinichi Ohtake, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 9 days.

This patent is subject to a terminal disclaimer.

(21) Appl. No.: 11/004,098

(22) Filed: Dec. 6, 2004

(65) Prior Publication Data

US 2005/0129536 A1 Jun. 16, 2005

(30) Foreign Application Priority Data

Dec. 10, 2003 (JP) ..... 2003-412175

(51) Int. Cl.
*F03C 2/00* (2006.01)
*F04C 18/00* (2006.01)

(52) U.S. Cl. ..... 418/55.6; 418/55.1; 418/97; 418/270; 418/DIG. 1; 55/423

(58) Field of Classification Search ..... 418/55.1–55.6, 418/57, 97, 270, DIG. 1; 55/423, 467, 459.1, 55/394, 396

See application file for complete search history.

(56) References Cited

U.S. PATENT DOCUMENTS

| | | | |
|---|---|---|---|
| 1,405,259 | A | 1/1922 | Beach |
| 1,854,692 | A | 4/1932 | Cooper |
| 3,317,123 | A | 5/1967 | Funke |
| 3,499,270 | A | 3/1970 | Paugh |
| 3,684,412 | A | 8/1972 | Harlin et al. |
| 3,850,009 | A | 11/1974 | Villadsen |
| 4,332,535 | A | 6/1982 | Terauchi et al. |
| 4,343,599 | A | 8/1982 | Kousokabe |
| 4,360,321 | A | 11/1982 | Copp, Jr. et al. |
| 4,470,778 | A | 9/1984 | Mabe |
| 4,496,293 | A | 1/1985 | Nakamura et al. |
| 4,547,138 | A | 10/1985 | Mabe et al. |

(Continued)

FOREIGN PATENT DOCUMENTS

| | | |
|---|---|---|
| DE | 2822780 | 12/1978 |

(Continued)

OTHER PUBLICATIONS

Certified Priority Document 2003-412175 filed Dec. 10, 2003.

*Primary Examiner*—Theresa Trieu
(74) *Attorney, Agent, or Firm*—Baker Botts L.L.P.

(57) ABSTRACT

The present invention provides a compressor capable of arranging a refrigerant discharge port regardless of the location of a separation chamber. In this compressor, a separation tube is pressed in through an opening of the separation chamber, and by engaging a regulating ring with an engagement groove provided in the inner wall of the separation chamber, the movement of the separation tube in the anti-insertion direction is regulated. Therefore, unlike the conventional compressor, a refrigerant discharge pipe for regulating the movement of the separation tube in the anti-insertion direction need not be connected to the upper part of the separation tube, and the refrigerant discharge port can be arranged freely regardless of the location of the separation section.

9 Claims, 7 Drawing Sheets

U.S. PATENT DOCUMENTS

| | | | | |
|---|---|---|---|---|
| 4,666,381 | A | | 5/1987 | Butterworth |
| 4,781,550 | A | | 11/1988 | Morishita et al. |
| 4,842,499 | A | | 6/1989 | Nishida et al. |
| 4,846,640 | A | | 7/1989 | Nishida et al. |
| 4,865,530 | A | | 9/1989 | Nishida et al. |
| 4,892,469 | A | | 1/1990 | McCullough et al. |
| 4,900,238 | A | | 2/1990 | Shigemi et al. |
| 4,932,845 | A | | 6/1990 | Kikuchi et al. |
| 4,936,756 | A | | 6/1990 | Shimizu et al. |
| 4,940,396 | A | | 7/1990 | Shimizu et al. |
| 4,958,991 | A | | 9/1990 | Kikuchi |
| 5,271,245 | A | | 12/1993 | Westermeyer |
| 5,395,224 | A | | 3/1995 | Caillat et al. |
| 5,421,708 | A | | 6/1995 | Utter et al. |
| 5,556,265 | A | | 9/1996 | Michiyuki et al. |
| 5,733,107 | A | * | 3/1998 | Ikeda et al. ..... 418/DIG. 1 |
| 5,800,133 | A | | 9/1998 | Ikeda et al. |
| 6,010,320 | A | | 1/2000 | Kwon |
| 6,017,205 | A | | 1/2000 | Weatherston et al. |
| 6,074,186 | A | | 6/2000 | Lifson et al. |
| 6,152,713 | A | * | 11/2000 | Hisanaga et al. ..... 418/55.2 |
| 6,227,831 | B1 | | 5/2001 | Osima et al. |
| 6,322,339 | B1 | | 11/2001 | Mitsunaga et al. |
| 6,454,538 | B1 | | 9/2002 | Witham et al. |
| 6,485,535 | B1 | * | 11/2002 | Linnersten et al. ..... 55/319 |
| 6,511,530 | B2 | * | 1/2003 | Iwanami et al. ..... 418/DIG. 1 |
| 6,755,632 | B1 | | 6/2004 | Ito et al. |
| 7,101,160 | B2 | | 9/2006 | Gennami et al. |
| 2001/0018025 | A1 | | 8/2001 | Sakai et al. |
| 2002/0134101 | A1 | | 9/2002 | Gennami et al. |
| 2005/0002800 | A1 | * | 1/2005 | Kimura et al. ..... 417/321 |
| 2005/0129556 | A1 | | 6/2005 | Ito |
| 2005/0226756 | A1 | | 10/2005 | Ito |
| 2005/0265878 | A1 | | 12/2005 | Ishida |
| 2005/0271534 | A1 | | 12/2005 | Yokoyama |
| 2006/0065012 | A1 | | 3/2006 | Kudo |

FOREIGN PATENT DOCUMENTS

| | | | | |
|---|---|---|---|---|
| EP | 0317900 | | | 5/1989 |
| JP | H54-047110 | A | | 4/1979 |
| JP | H57-143187 | A | | 9/1982 |
| JP | 61205386 | | | 9/1986 |
| JP | S61-223292 | A | | 10/1986 |
| JP | 6316190 | | | 1/1988 |
| JP | H63-106393 | A | | 5/1988 |
| JP | 07151083 | A | * | 6/1995 |
| JP | H11-082352 | A | | 3/1999 |
| JP | 2000-073967 | A | | 3/2000 |
| JP | 2000-080982 | A | | 3/2000 |
| JP | 2000080982 | A | * | 3/2000 |
| JP | 2000170681 | A | * | 6/2000 |
| JP | 2001-065454 | A | | 3/2001 |
| JP | 2001 295767 | | | 10/2001 |
| JP | 2002-250288 | A | | 9/2002 |
| JP | 2002250288 | A | * | 9/2002 |
| WO | WO8505403 | | | 12/1985 |
| WO | WO8600369 | | | 1/1986 |

* cited by examiner

COMPRESSOR INCLUDING SEPARATION TUBE ENGAGEMENT MECHANISM

BACKGROUND OF THE INVENTION (i) Field of the Invention

The present invention relates to a compressor used to compress a refrigerant for, for example, a vehicular air conditioner.

(ii) Description of the Related Art

Conventionally, a compressor of this type includes a compressor body, a compression section for compressing a refrigerant sucked into the compressor body, and a separation chamber for separating a lubricating oil, which is contained in the refrigerant discharged from the compression section, from the refrigerant. Thereby, the refrigerant compressed together with the lubricating oil in the compression section in the compressor body is separated into refrigerant and lubricating oil in the separation chamber, and the separated refrigerant is discharged to the outside of the compressor body.

Also, the separation chamber is provided with a separation tube in the vertically extending separation chamber having a circular cross section, and is configured so that the refrigerant containing the lubricating oil is caused to flow in the tangential direction of the inner wall in the upper part of the separation chamber and is swirled along the inner wall. Thereby, the lubricating oil contained in the refrigerant adheres to the inner wall of the separation chamber and is separated from the refrigerant, and the separated refrigerant flows in the separation tube and is discharged to the outside of the compressor body.

However, in the conventional compressor, a pipe serving as a refrigerant discharge port is connected to the upper part of the separation chamber, and the separation tube is fixed by the end portion of the pipe. Therefore, since the location of the refrigerant discharge port is limited to the upper part of the separation chamber, the degree of freedom of the arrangement of refrigerant discharge port may be restricted.

SUMMARY OF THE INVENTION

An object of the present invention is to provide a compressor capable of arranging a refrigerant discharge port regardless of the location of a separation chamber.

To achieve the above object, the present invention provides a compressor comprising a compressor body; a compression section for compressing a refrigerant sucked in the compressor body; a separation chamber for separating a lubricating oil, which is contained in the refrigerant discharged from the compression section, from the refrigerant; and a separation tube fixed in the separation chamber, wherein a regulating portion for regulating the movement of the separation tube is provided on the inner wall of the separation chamber.

Thereby, since the movement of the separation tube is regulated by locking the separation tube by the regulating portion, the separation tube is fixed in the separation chamber without connecting a refrigerant discharge pipe to the opening through which the separation tube is inserted.

Also, the present invention provides a compressor comprising a compressor body; a compression section for compressing a refrigerant sucked in the compressor body; a separation chamber for separating a lubricating oil, which is contained in the refrigerant discharged from the compression section, from the refrigerant; a separation tube which is inserted through an opening provided in the compressor body, and is fixed in the separation chamber; and a seal member which closes the opening of the compressor body and regulates the movement of the separation tube in the anti-insertion direction by locking the lower end thereof to one end of the separation tube, wherein the seal member is provided with a communication hole for causing a refrigerant in the separation chamber to flow toward a refrigerant discharge port of the compressor body.

Thereby, the movement of the separation tube in the anti-insertion direction is regulated by locking the lower end of the seal member to one end of the separation tube, and the refrigerant in the separation chamber is caused to flow toward the refrigerant discharge port of the compressor body through the communication hole. Therefore, the separation tube is fixed in the separation chamber without connecting the refrigerant discharge pipe to the opening through which the separation tube is inserted.

Therefore, since the separation tube can be fixed in the separation chamber without connecting the refrigerant discharge pipe to the opening through which the separation tube is inserted, the refrigerant discharge port of the compressor body can be arranged freely regardless of the location of the opening for inserting the separation tube.

These and other objects, features, and advantages of the present invention will become more apparent in the detailed description and accompanying drawings which follow.

DESCRIPTION OF THE PREFERRED EMBODIMENTS

Figure 1:
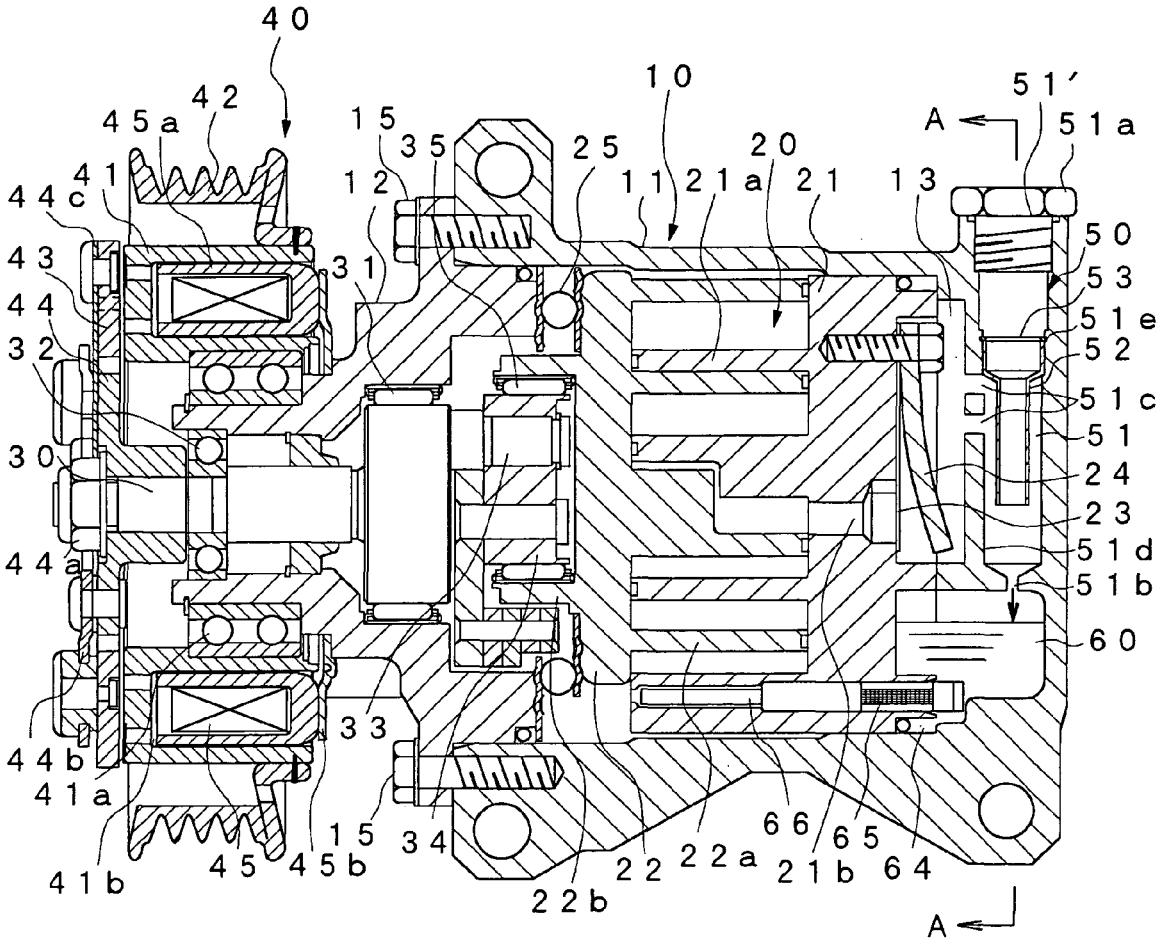
FIG. 1 is a side sectional view of a compressor in accordance with a first embodiment of the present invention.
Figure 2:
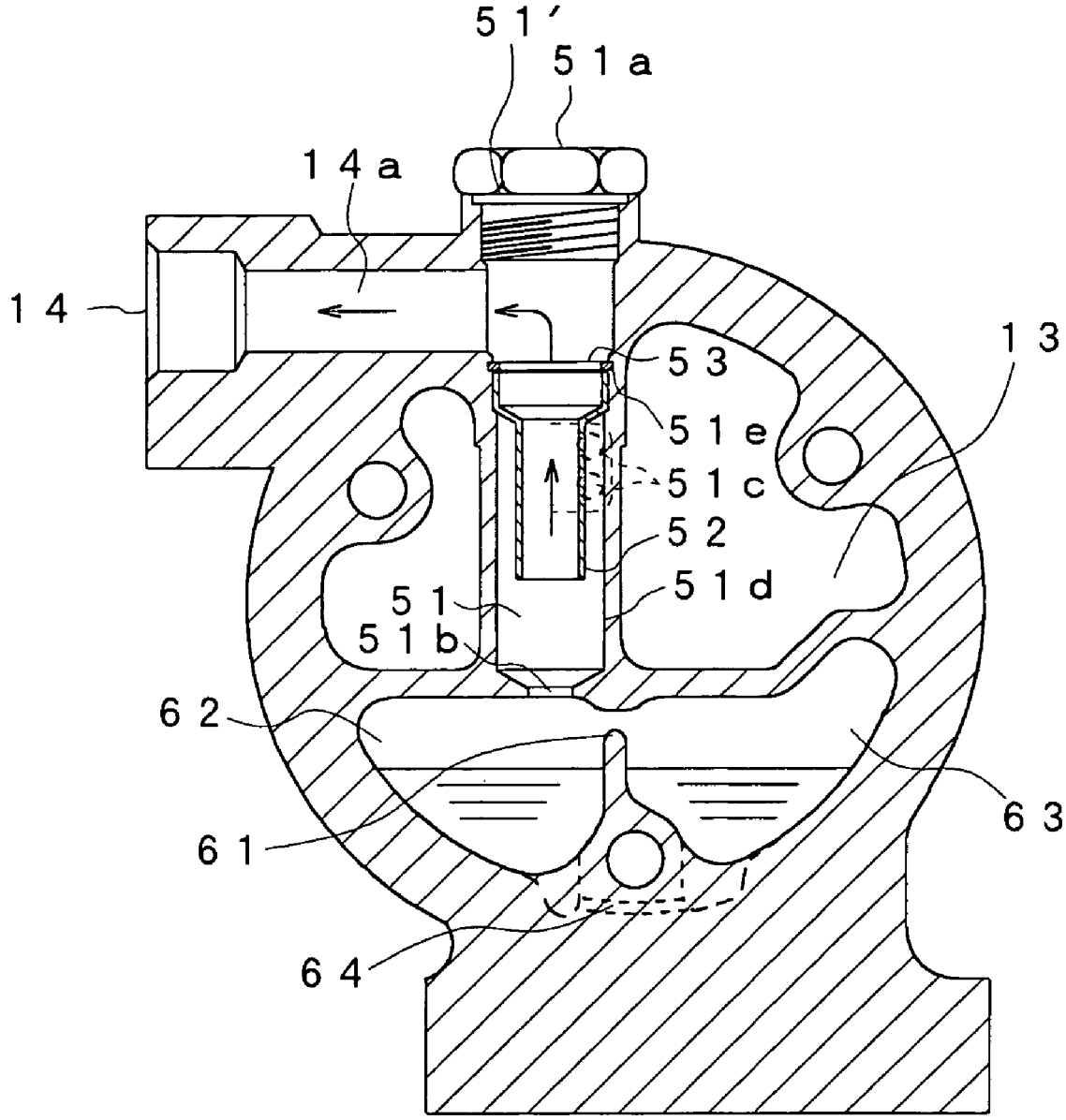
FIG. 2 is a sectional view taken along the line A-A of FIG. 1.
Figure 3:
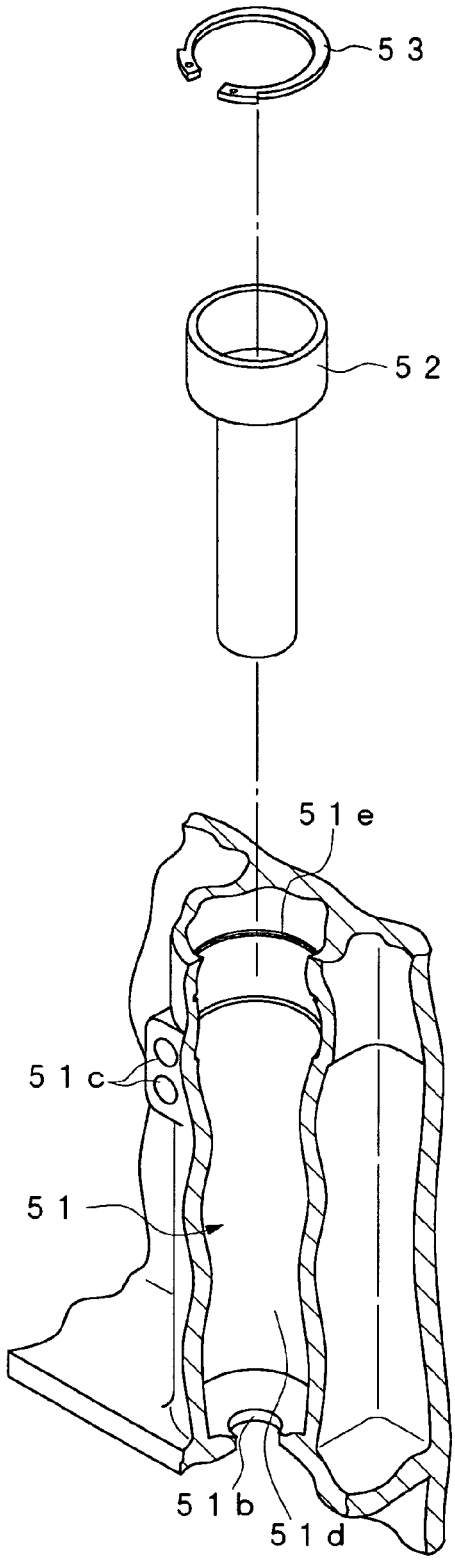
FIG. 3 is an exploded perspective view of a separation section.
Figure 4:
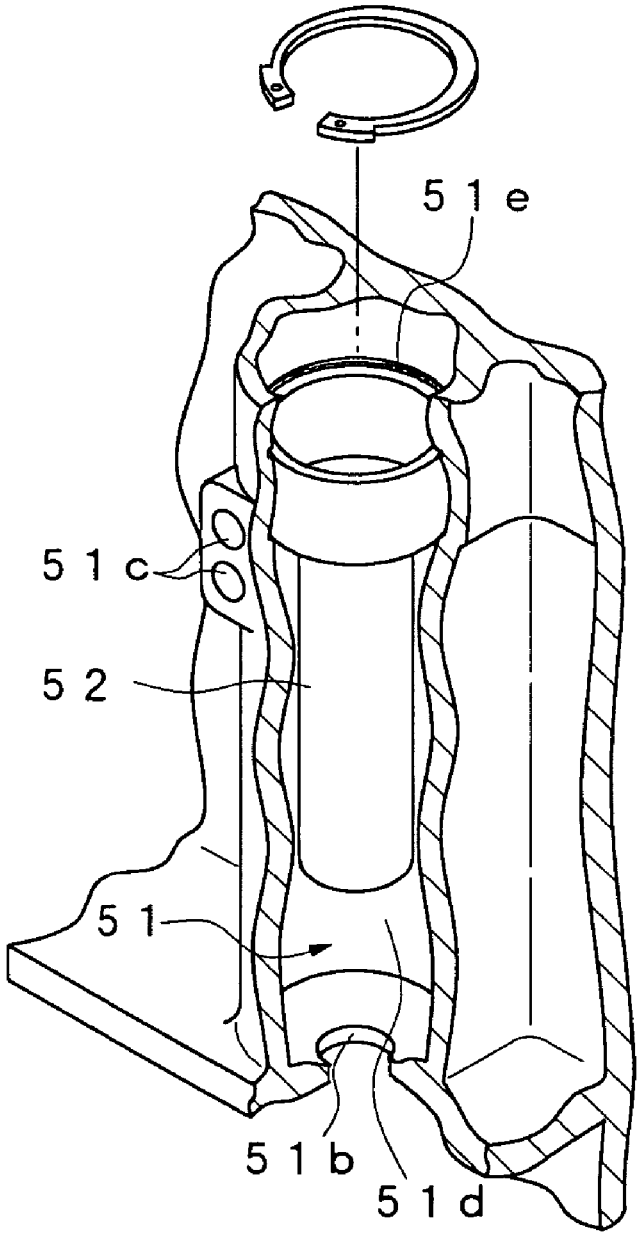
FIG. 4 is an exploded perspective view of a separation section.
Figure 5:
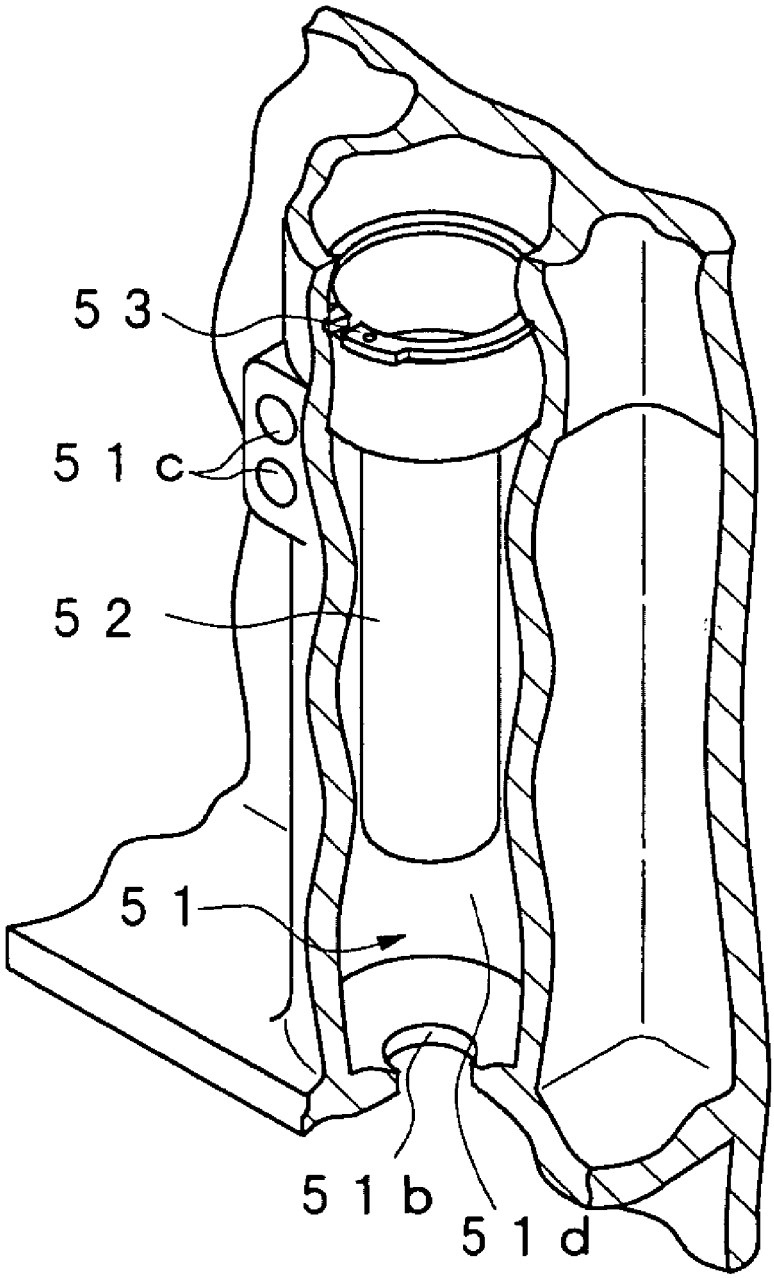
FIG. 5 is an exploded perspective view of a separation section.

FIGS. 1 to 5 show a first embodiment of the present invention.

A compressor of this embodiment includes a compressor body 10, a compression section 20 for compressing a refrigerant sucked into the compressor body 10, a drive shaft 30 for driving the compression section 20, an electromagnetic clutch 40 for transmitting power supplied from the outside to the drive shaft 30, a separation section 50 for separating a lubricating oil, which is contained in the refrigerant discharged from the compression section 20, from the refrigerant, and a oil storage chamber 60 for storing the separated lubricating oil and supplying it to the refrigerant suction side of the compression section 20.

The compressor body 10 is formed in a hollow shape, and consists of a first housing 11 and a second housing 12. The first housing 11 forms one end surface and the side surface of the compressor body 10, and a refrigerant discharge chamber 13 is provided on one end side of the interior of the first housing 11. Also, a refrigerant suction port, not shown, is provided in the side surface of the first housing 11, and a refrigerant discharge port 14 is provided in the side surface on one end surface side. The second housing 12 forms the other end surface side of the compressor body 10, and is fixed to the first housing 11 by bolts 15.

The compression section 20 consists of a fixed scroll member 21 arranged on one end side in the first housing 11 and a movable scroll member 22 arranged on the other end side in the first housing 11, and the fixed scroll member 21 is fixed in the first housing 11 so as to partition the refrigerant discharge chamber 13. One spiral wrap 21*a* is provided on one end surface of the fixed scroll member 21, and a through hole 21*b* communicating with the refrigerant discharge chamber 13 is provided substantially in the center of the fixed scroll member 21. Also, on the other end surface of the fixed scroll member 21 is provided a plate-shaped discharge valve 23 for opening and closing the through hole 21*b*. The discharge valve 23 is configured so as to regulate the opening angle by using a stopper 24 provided on the other end surface of the fixed scroll member 21. The other spiral wrap 22*a* is provided on one end surface of the movable scroll member 22, and on the other end surface of the movable scroll member 22 is provided a boss portion 22*b* extending toward the second housing 12. Also, between the movable scroll member 22 and the second housing 12, a rotation checking mechanism 25 is provided so that the movable scroll member 22 performs orbital motion without rotating by means of the rotation checking mechanism 25.

One end side of the drive shaft 30 is rotatably supported by the second housing 12 via a roller bearing 31, and the other end side thereof is rotatably supported by the second housing 12 via a ball bearing 32. On one end surface of the drive shaft 30, an eccentric pin 33 that is off-centered with respect to the axis is projectingly provided, and the eccentric pin 33 is inserted in an eccentric bush 34. Also, the eccentric bush 34 is rotatably supported by the boss portion 22*b* on the movable scroll member 22 via a roller bearing 35.

The electromagnetic clutch 40 includes a rotor 41 rotating coaxially with the drive shaft 30, a pulley 42 provided integrally with the rotor 41, an armature 43 rotating coaxially with the rotor 41, a hub 44 rotating integrally with the armature 43, and an electromagnetic coil 45 capable of attracting the axial opposed surfaces of the rotor 41 and the armature 43 to each other by means of a magnetic force.

The rotor 41 consists of a magnetic body formed in a ring shape, and the inner peripheral surface thereof is rotatably supported by the second housing 12 of the compressor body 10 via a ball bearing 41*a*. On one end side of the rotor 41 is provided a ring-shaped concave portion 41*b*, and the electromagnetic coil 45 is contained in this concave portion 41*b*. The other end surface of the rotor 41 is opposed to the armature 43 in the axial direction so that the armature 43 is attracted by the electromagnetic coil 45.

The pulley 42 is provided on the outer peripheral surface of the rotor 41, and a V belt, not shown, is set around the pulley 42.

The armature 43 consists of a magnetic body formed by a ring-shaped plate member, and one end surface thereof is opposed to the other end surface of the rotor 41 via a slight gap so as to be attracted to the other end surface of the rotor 41 by the electromagnetic coil 45.

The hub 44 consists of a metallic member formed in a disc shape. To the center thereof is connected one end side of the drive shaft 30, and the drive shaft 30 is fixed to the hub 44 by a nut 44*a*. The hub 44 is connected to the armature 43 via a connecting plate 44*b* and a plate spring 44*c*. The armature 43 can be displaced toward the rotor 41 by the elastic deformation of the plate spring 44*c*.

The electromagnetic coil 45 consists of a winding of an insulating coated conductor, and mold fixed in a stator 45*a* by a resin member such as epoxy resin. The stator 45*a* consists of a magnetic body having a substantially U-shaped cross section, which is formed in a ring shape, and is fixed in the concave portion 41*a* of the rotor 41. Also, the stator 45*a* is connected to the compressor body 10 via a ring-shaped connecting member 45*b*.

The separation section 50 is made up of a separation chamber 51 located between the refrigerant discharge chamber 13 and the refrigerant discharge port 14 and a separation tube 52 provided in the separation chamber 51.

The separation chamber 51 is configured so that one end side of the first housing 11 is open from the upside of the outside, by which a vertically extending space having a circular cross section is formed. Also, a threaded portion is formed on an inner wall 51*d* on the upper end side of the separation chamber 51 so that the separation chamber 51 is closed by a seal bolt 51*a*. Further, a refrigerant passage 14*a* for causing the refrigerant to flow to the refrigerant discharge port 14 communicates with an upper part of the separation chamber 51 from the side. The lower end side of the separation chamber 51 is formed so as to be inclined toward the center of the lower surface, and an introduction hole 51*b* communicating with the oil storage chamber 60 is provided at the lowest part. Also, on the refrigerant discharge chamber 13 side in an upper part of the separation chamber 51, a pair of communication holes 51*c* are provided at an interval vertically. These communication holes 51*c* are arranged in the tangential direction of the circumference-shaped inner wall 51*d* at a predetermined distance in the width direction with respect to the center axis of the separation chamber 51. Further, in the inner wall 51*d* just above the separation tube 52 provided in the separation chamber 51, an engagement groove 51*e* is provided along the circumferential direction so that a regulating ring 53, which has elasticity as a regulating member and is formed in a C shape, engages with the engagement groove 51*e*.

The separation tube 52 is formed by a member formed in a substantially cylindrical shape. The upper end side thereof is formed so as to be in contact with the inner wall 51*d* of the separation chamber 51, and the lower side thereof is formed so as to have a predetermined clearance from the inner wall 51*d*. The separation tube 52 is inserted in the separation chamber 51 through an upper opening 51' of the separation chamber 51, and the upper end side of the separation tube 52 is pressed in the separation chamber 51. In this case, by engaging the regulating ring 53 with the engagement groove 51*e* of the separation chamber 51, the upward movement of the separation tube 52 is regulated. Also, a predetermined clearance is provided between the lower end side of the separation tube 52 and the lower surface of the separation chamber 51.

The oil storage chamber 60 is formed between one end side of the first housing 11 and the other end side of the fixed scroll member 21. The oil storage chamber 60 is formed with a first oil storage chamber 62 and a second oil storage chamber 63 by partitioning the oil storage chamber 60 by a partition wall 61 so that the upper part of the oil storage chamber 60 communicates in the right-and-left direction in FIG. 2. Also, the lower parts of the first oil storage chamber 62 and the second oil storage chamber 63 are connected to each other by a communication path 64 formed between the first housing 11 and the fixed scroll member 21. An upper part of the first oil storage chamber 62 communicates with the separation section 50 via the introduction hole 51*b*, and a lower part of the second oil storage chamber 63 communicates with the refrigerant suction side of the compression section 20 via a filter 65 and an orifice 66, which are provided in the fixed scroll member 21.

In the compressor constructed as described above, when the power of an engine is supplied to the pulley 42 of the electromagnetic clutch 40, the rotor 41 rotates integrally with the pulley 42. At this time, when the electromagnetic coil 45 is in a de-energized state, the axial opposed surfaces of the rotor 41 and the armature 43 are held with a gap provided therebetween, and hence the rotor 41 rotates freely with respect to the armature 43, so that the rotating force of the rotor 41 is not transmitted to the armature 43. When the electromagnetic coil is energized, the armature 43 is attracted toward the rotor 41 by the magnetic force of the electromagnetic coil 45, so that the rotor 41 and the armature 43 are pressed on each other and engaged frictionally with each other. Thereby, the rotating force of the rotor 41 is transmitted, so that the rotating force of the armature 43 is transmitted to the drive shaft 30.

When the drive shaft 30 is rotated, the movable scroll member 22 of the compression section 20 performs a predetermined orbiting motion by means of the rotation of the eccentric bush 34. Thereby, the refrigerant flowing into the first housing through the refrigerant suction port of the compressor body 10 is sucked to between the spiral wrap 22*a* of the movable scroll member 22 and the spiral wrap 21*a* of the fixed scroll member 21, and is compressed between the spiral wraps 21*a* and 22*a*. The detailed explanation of the compressing operation of the spiral wraps 21*a* and 22*a* is omitted because this compressing operation is the same as that of the publicly known scroll compressor.

The compressed refrigerant is discharged into the refrigerant discharge chamber 13, and is discharged from the refrigerant discharge chamber 13 into the separation chamber 51 via the communication holes 51*c*. Since the communication holes 51*c* are arranged in the tangential direction of the inner wall 51*d* at a predetermined distance in the width direction with respect to the center axis of the separation chamber 51, the compressed refrigerant lowers while swirling along the inner wall 51*d* of the separation chamber 51. At this time, the compressed refrigerant contains the lubricating oil. By swirling the compressed refrigerant along the inner wall 51*d* of the separation chamber 51, the lubricating oil adheres to the inner wall 51*d* of the separation chamber 51 and is separated from the refrigerant. The refrigerant from which the lubricating oil is separated is discharged from the lower end of the separation tube 52 to the outside through the refrigerant discharge port 14. The lubricating oil lowers by means of the gravity, and is discharged into the oil storage chamber 60 via the introduction hole 51*b* in the lower part of the separation chamber 51.

The lubricating oil discharged from the separation section 50 flows in the first oil storage chamber 62 of the oil storage chamber 60, and flows into the second oil storage chamber 63 via the communication path 64. The lubricating oil flowing into the second oil storage chamber 63 is attracted to the refrigerant suction side of the compression section 20 by a difference in internal pressure between the refrigerant suction side of the compression section 20 and the oil storage chamber 60. After impurities are removed from the lubricating oil by the filter 65, the supply amount of lubricating oil is regulated by the orifice 66, and the lubricating oil is supplied to the refrigerant suction side of the compression section 20.

According to the compressor of this embodiment, the separation tube 52 is pressed in through the opening 51' of the separation chamber 51, and by engaging the regulating ring 53 with the engagement groove 51*e* provided in the inner wall 51*d* of the separation chamber 51, the movement of the separation tube 52 in the anti-insertion direction is regulated. Therefore, unlike the conventional compressor, a refrigerant discharge pipe for regulating the movement of the separation tube 52 in the anti-insertion direction need not be connected to the upper part of the separation tube 52, and the refrigerant discharge port 14 can be arranged freely regardless of the location of the separation section 50.

Figure 6:
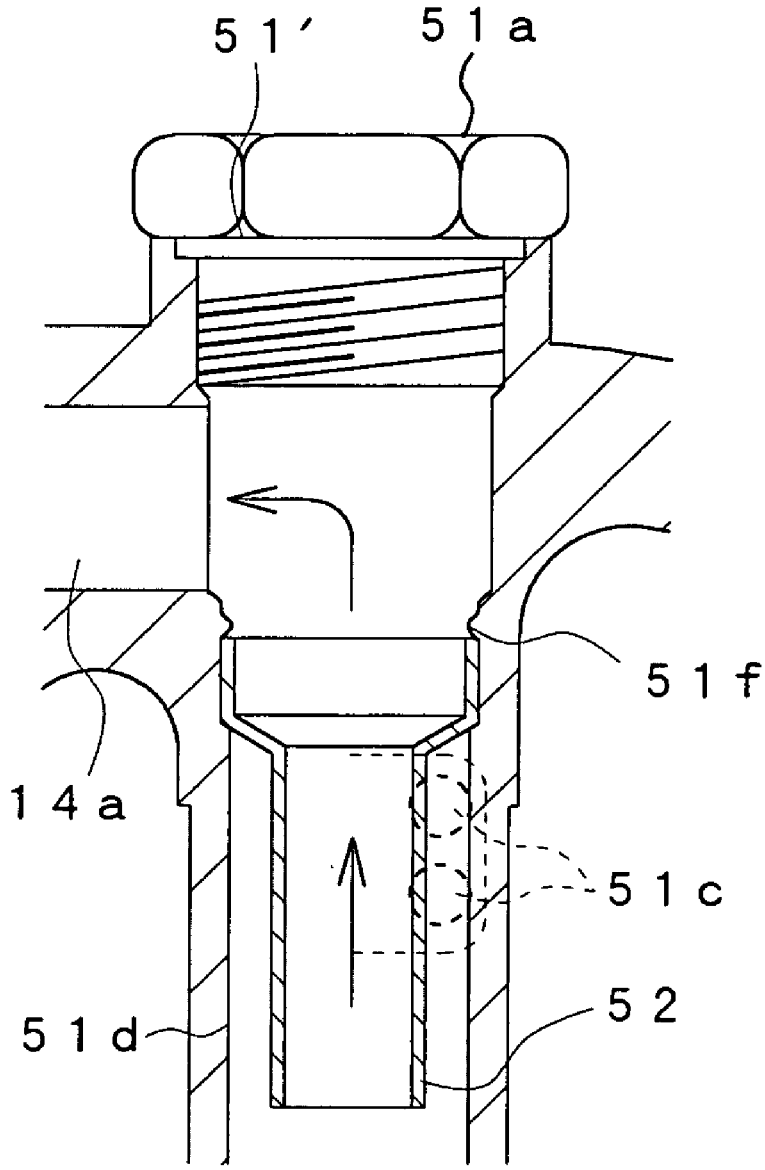
FIG. 6 is a side sectional view showing a regulating portion in a separation chamber.

In the above-described embodiment, an example has been shown in which by engaging the regulating ring 53 with the engagement groove 51*e* provided in the inner wall 51*d* of the separation chamber 52, the movement of the separation tube 52 in the anti-insertion direction is regulated. However, as shown in FIG. 6, a part of the inner wall 51*d* located at the upper part of the separation tube 52 may be deformed by staking etc. so as to project to the inside of the separation chamber 51 to regulate the movement of the separation tube 52 in the anti-insertion direction by means of a regulating portion 51*f*.

Figure 7:
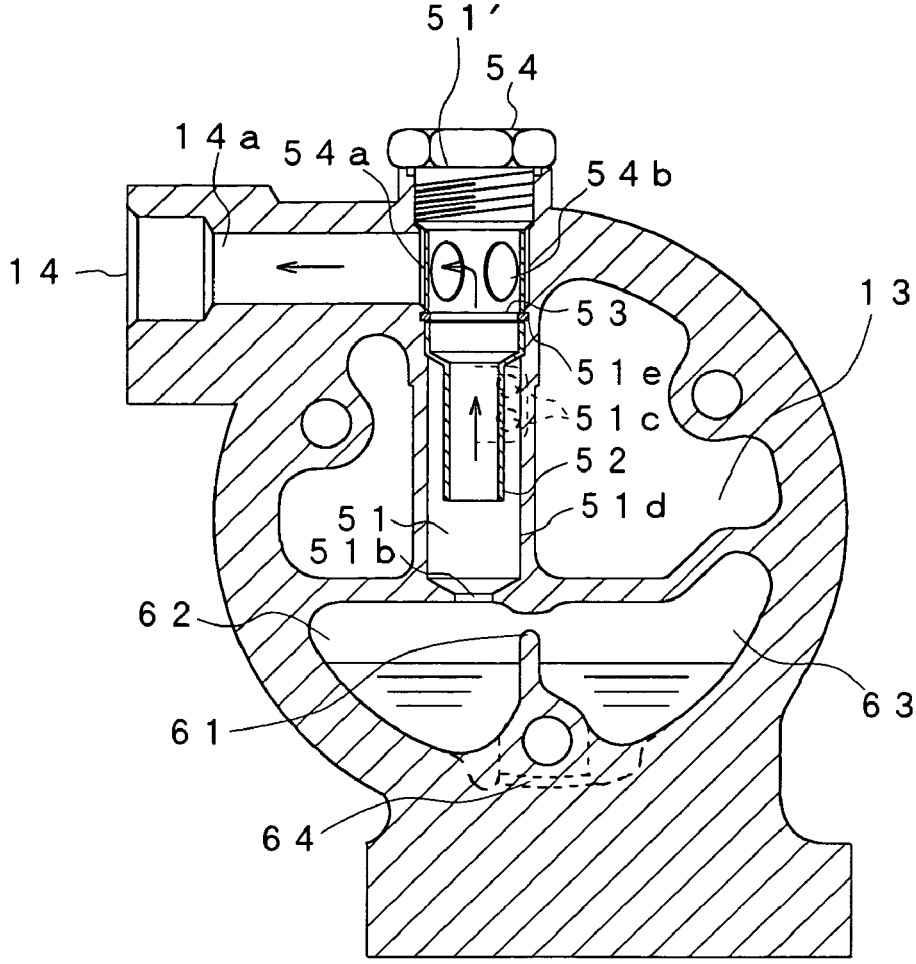
FIG. 7 is a sectional view taken along the line A-A of a compressor, showing a second embodiment.
Figure 8:
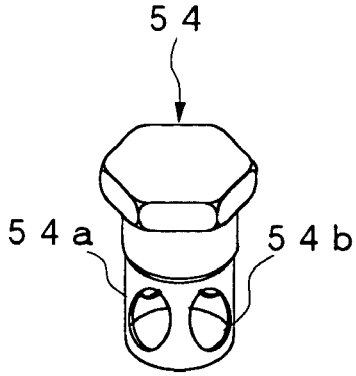
FIG. 8 is a perspective view showing a seal bolt.

FIGS. 7 and 8 show a second embodiment of the present invention. In FIGS. 7 and 8, the same reference numerals are applied to elements equivalent to those in the first embodiment.

In the compressor of this embodiment, a cylindrical portion 54*a* whose lower end is open is integrally provided at the lower part of a seal bolt 54 for closing the upper end of the separation chamber 51, and a plurality of communication holes 54*b* are provided in the side surface of the cylindrical portion 54*a* at intervals in the circumferential direction.

That is to say, when the seal bolt 54 is engaged threadedly with the upper end of the separation chamber 51, the lower end of the cylindrical portion 54*a* of the seal bolt 54 locks the upper end of the separation tube 52, by which the upward movement of the separation tube 52 is regulated. In this case, the refrigerant discharged from the separation tube 52 flows through the communication holes 54*b* of the cylindrical portion 54*a*, and is discharged through the refrigerant discharge port 14 via the refrigerant passage 14*a*.

Thus, according to the compressor of this embodiment, the separation tube 52 is pressed in through the opening 51' of the separation chamber 51, and the seal bolt 54 is engaged threadedly with the opening 51', by with the movement of the separation tube 52 in the anti-insertion direction is regulated by the end portion of the cylindrical portion 54*a*. Therefore, unlike the conventional compressor, a refrigerant discharge pipe for regulating the movement of the separation tube 52 in the anti-insertion direction need not be connected to the upper part of the separation tube 52, and the refrigerant discharge port 14 can be arranged freely regardless of the location of the separation section 50.

Also, the seal bolt is engaged threadedly with the inner surface of the opening 51' at the upper end of the separation chamber 51 to close the opening 51'. Therefore, the seal bolt can be installed to the opening 51' easily, by which the manpower for assembly can be reduced.

The preferred embodiments described in this specification are typical examples, and the present invention is not limited to the above-described embodiments. The scope of the invention is shown in the appended claims, and all changes and modifications included in the meaning of these claims are embraced in the present invention.

What is claimed is:

1. A compressor comprising:

a compressor body;

a compression section for compressing a refrigerant sucked in said compressor body;

a separation chamber for separating a lubricating oil, which is contained in the refrigerant discharged from said compression section, from the refrigerant;

a separation tube fixed in said separation chamber;

a discharge port in fluid communication with said separation chamber from a side of said separation chamber; and a refrigerant passage for providing a refrigerant fluid communication path from an upper end of said separation chamber to said discharge port, wherein a regulating portion for regulating the movement of said separation tube towards said refrigerant passage is provided on an inner wall of said separation chamber, and wherein said discharge port is positioned downstream from said separation chamber to receive separated refrigerant from said separation chamber.

2. The compressor according to claim 1, wherein said regulating portion is formed by deforming a part of the inner wall of said separation chamber so that the part projects to the inside of said separation chamber.

3. The compressor according to claim 1, wherein a length of said separation chamber extends along a first direction and a length of the refrigerant passage extends along a second direction different from the first direction.

4. The compressor according to claim 3, wherein the first direction is substantially orthogonal to the second direction.

5. A compressor comprising:

a compressor body;

a compression section for compressing a refrigerant sucked in said compressor body;

a separation chamber for separating a lubricating oil, which is contained in the refrigerant discharged from said compression section, from the refrigerant;

a separation tube fixed in said separation chamber, and a regulating portion for regulating a movement of said separation tube, wherein said regulating portion is formed by an engagement groove provided in the inner wall of said separation chamber and an engagement member configured to engage said engagement groove.

6. The compressor according to claim 5, wherein said engagement member comprises a member which has elasticity and is formed in a C-shape.

7. A compressor comprising:

a compressor body;

a compression section for compressing a refrigerant sucked in said compressor body;

a separation chamber for separating a lubricating oil, which is contained in the refrigerant discharged from said compression section, from the refrigerant;

a separation tube which is inserted through an opening provided in said compressor body, and is fixed in said separation chamber; and a seal member which closes the opening of said compressor body and regulates the movement of said separation tube in the anti-insertion direction by locking a lower end thereof to one end of said separation tube, wherein said seal member is provided with a communication hole for causing the refrigerant in the separation chamber to flow toward a refrigerant passage provided on an inner wall of said separation chamber in fluid communication with a refrigerant discharge port of said compressor body.

8. The compressor according to claim 7, wherein said seal member is provided with a threaded portion configured to engage threadedly with the opening of said compressor body.

9. The compressor according to claim 7, wherein the refrigerant passage is located in said compressor body, and the refrigerant passage provides a refrigerant fluid communication path from an upper end side of said separation chamber to said refrigerant discharge port of said compressor body.

* * * * *